United States Patent [19]

Rhoads

[11] Patent Number: 4,694,787

[45] Date of Patent: Sep. 22, 1987

[54] AUTOMATIC FLUID DISTRIBUTING VALVE TIMING DEVICE

[76] Inventor: Gary E. Rhoads, 8565 Boulder Dr., La Mesa, Calif. 92041

[21] Appl. No.: 583,998

[22] Filed: Feb. 27, 1984

[51] Int. Cl.[4] ..... F01L 9/02

[52] U.S. Cl. ..... 123/90.13; 123/90.12

[58] Field of Search ..... 123/90.11, 90.12, 90.13

[56] References Cited

U.S. PATENT DOCUMENTS

| | | | |
|---|---|---|---|
| 2,692,588 | 10/1954 | Cathers | 123/90.13 |
| 2,763,249 | 9/1956 | Flynn | 123/90.12 |
| 2,788,777 | 4/1957 | Clark | 123/90.12 |
| 2,915,052 | 12/1959 | Gullen | 123/90.12 |
| 2,962,013 | 11/1960 | Reggio | 123/90.13 |
| 3,865,088 | 2/1975 | Links | 123/90.12 |
| 3,872,844 | 3/1975 | Gates | 123/90.12 |
| 3,926,159 | 12/1975 | Michelson et al. | 123/90.12 |
| 4,009,695 | 3/1977 | Ule | 123/90.12 |

*Primary Examiner*—Ira S. Lazarus

[57] ABSTRACT

A automatic fluid distributing valve timing device in combination with an internal combustion engine of which is adjustable and variable, a device controlling opening and closing degrees of the valves in relationship to the crankshaft of a common reciprocating engine. This device controls the opening of a valve by a pressurized oil co-ordinating disk working in conjunction with a actuating piston attached to the cylinder head of a high performance engine, of which when fed by oil pressure, opens intake and exhaust valves by the alignment of two elements allowing oil to flow for a regulated time and of which is adjustable, adjusting valve duration, overlap and lift. This device eliminates multiple working parts of the engines valve train such as the conventional cam, lifters, push rods and rocker arms, eliminating a large percent of friction and horsepower loss. The novel invention has very few working parts compared to the above mentioned valve train, resulting in a large horsepower increase. The device gives the proper valve duration, overlap and lift throughout the entire r.p.m. range automatically, while improving engine combustion, fuel economy and smog pollution emissions, such as carbon monoxide and hydrocarbons. This may be a new break through in the smog control problems, which will revolutionize the combustion engine.

11 Claims, 11 Drawing Figures

AUTOMATIC FLUID DISTRIBUTING VALVE TIMING DEVICE

BACKGROUND AND SUMMARY OF INVENTION

In a common gas reciprocating engine the crankshaft attaches to a camshaft by a sprocket and a chain of a ratio of two to one. The cam opens the valves by a cam follower called a lifter and attaches a push rod of which attaches to a rocker arm on the cylinder head, which in turn opens the valves. Of course to run and operate these parts it robs horsepower due to the extra friction and weight, less friction more horsepower. These cam timing devices are relatively complexed and expensive due to many working parts, wherein fact they are fixed, ground for a specific application for horsepower characteristics and cubic inch displacement. In order to change cam duration and overlap specifications, the cam therefore would be replaced to change such specifications. There are devices of which index cam timing by advancing and retarding the camshaft automatically, flexable and inflexable devices. Also there are valve timing devices of which changes cam duration and overlap automatically, but the rate of oil bleed is fixed without being able to adjust for varing rates of lift and other variables. Refer to our patent filed June 20, 1966 U.S. Pat. No. 3,304,935 inventor James E. Rhoads and myself Gary E. Rhoads as co-inventor (not shown). Also another U.S. Pat. No. 3,921,609 filed Aug. 16, 1974, of which was assigned to my brother Jack L. Rhoads for marketing.

BRIEF DISCRIPTION OF THE INVENTION

The present invention relates to valve timing devices and more particularly to the complete valve train, the camshaft, lifters, pushrods and rocker arms, of which may become obsolete.

The main novel feature of the invention resides in the provision of a automatic fluid distributing valve timing device of which eliminates the entire modern day valve train components. Cutting down on friction, wear and loss of horsepower to operate these parts. Resulting in a much simpler system with an increase horsepower gain which may prove to be phenomenal. The valve timing device herein is designed to provide favorable characteristics over the entire speed range, more revolutions per minute (r.p.m.s) and faster acceleration.

As far as combustion the novel features allows a more complete burn, lowering air smog pollutent gases such as carbon monoxide and hydrocarbons. With such characteristics engine performance is improved to a phenomenal degree resulting at low r.p.m.s, a much higher compression of which burns gases more thorough due to the elimination of valve overlap and large duration profiles, that is needed only at higher r.p.m.s. this device is designed whereby the demands of large valve overlap and duration automatically self adjusts while r.p.m.s change throughout the r.p.m. power range, allowing for the most perfect cam profiles. This is accomplished by providing a oil fed rotor sprocket that is driven by the crankshaft sprocket, therefore aligning when turned to a series of adjustable aperture disks. Adjustments may also be made while the engine is running. The disk attaches a face plate having a configuration of oil lines transfering oil at the proper time to an actuated piston embodiment attached to the cylinder head directly over the intake and exhaust valves. This embodiment is equipped with adjusting means one of which controls a bleed duct, while at low and intermediate speeds oil leaks in the pressure chamber allowing a delay, of which time the valve is opened and closed. At high speeds the motion is so rapid that the oil can no longer escape to any degree through the restricted leak path, the distributing rotor cam device and the actuating piston both allow a change of time to take place opening the valve sooner and staying opened longer. The second adjustment is one in which changes cam lift by changing the volume of oil in the chamber. The adjusting screw allows a second piston to narrow down the volume in the oil pressure chamber area, consequently forcing the actuating piston to travel further opening the valve wider. Cam duration, overlap and valve lift can be adjusted with engine running to any chosen size and alters cam profiles automatically from small to large.

BRIEF DISCRIPTION OF THE DRAWINGS

DETAILED DESCRIPTION OF THE PREFERRED EMBODIMENTS

Figure 1:
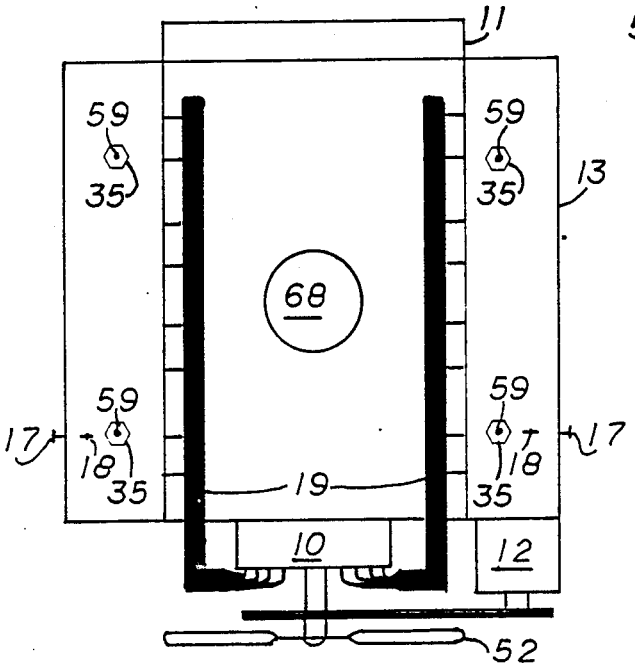
FIG. 1 is a schematic top plan view, as showing it attached to a modern V8 engine.
Figure 2:
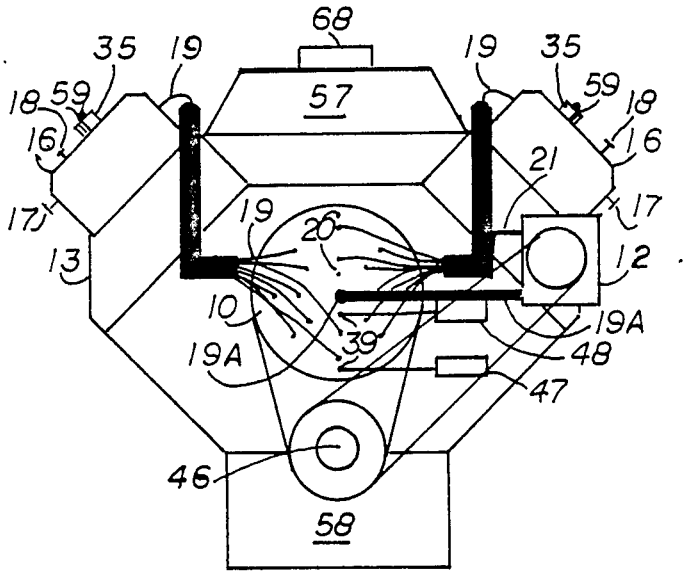
FIG. 2 is a schematic front elevation of the preferred embodiment, showing it attached to a modern V8 engine.
Figure 4:
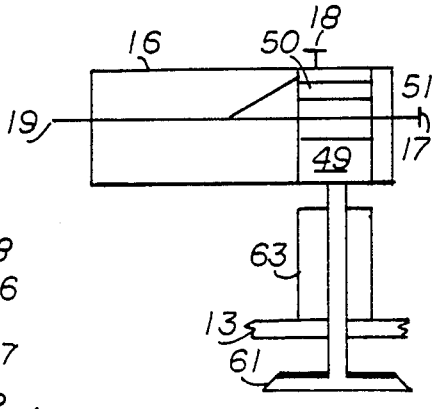
FIG. 4 is a schematic diagram showing the actuation piston unit of the preferred novel valve actuation unit system.
Figure 4A:
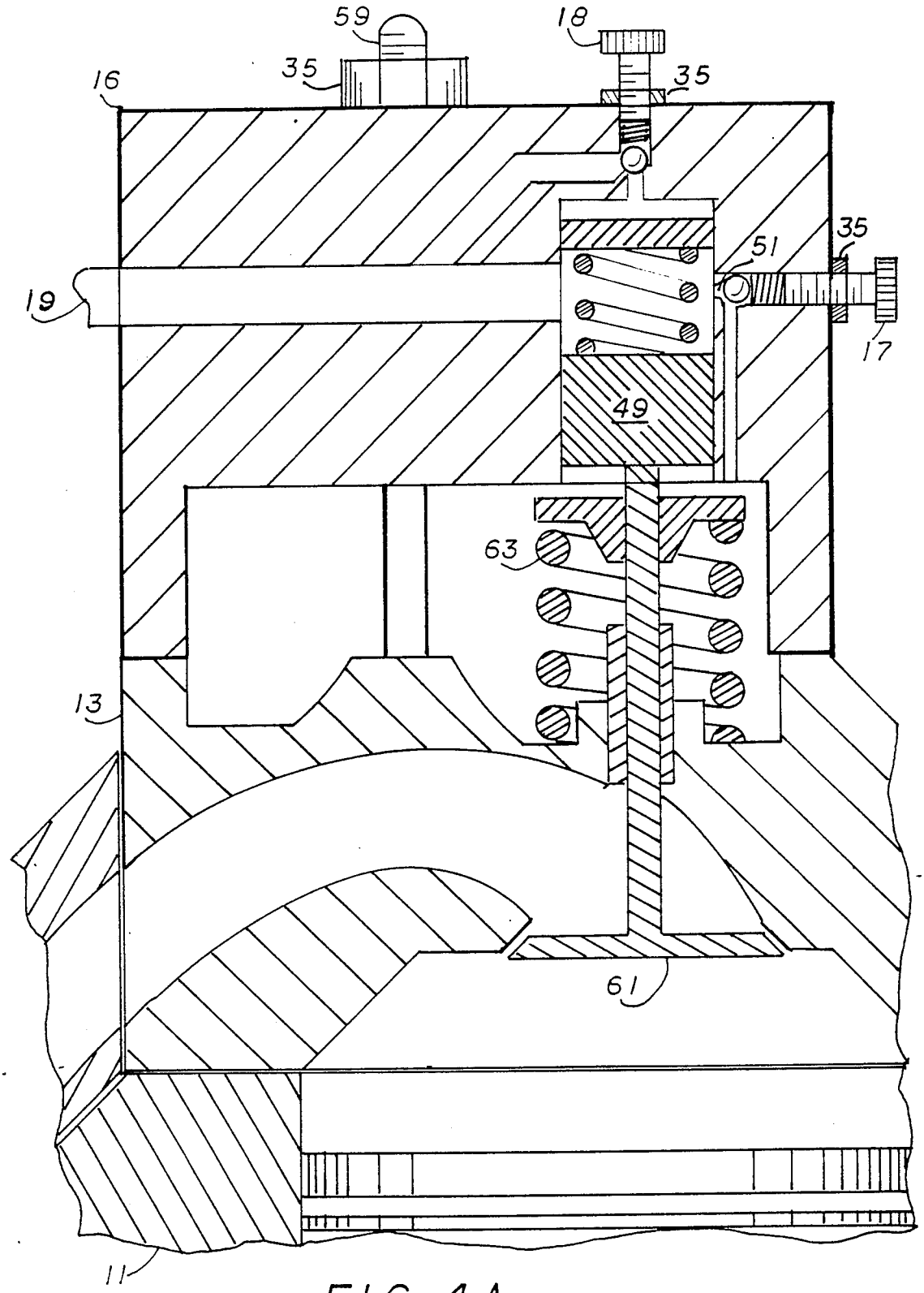
FIG. 4A is a sectional view of the preferred novel valve actuation embodiment, showing as it is attached to an engine.

FIG. 1 shows the novel preferred embodiment 10 attached to an internal combustion V-8 engine 11 attached therewith a secondary high pressure oil pump 12 of which supplies a secondary pressure through the distributing rotorcam 19A and out through high pressure lines 19 to the actuating pistons embodiment unit 16, to the necessary proper timed actuating piston 49 of FIG. 4 which opens and closes intake valve 15 and exhaust 14 whereby the engine 11 operates and runs without all those other heavy friction causing parts, camshaft, valve lifters, pushrods and rocker arms, of which robs horsepower and economy. FIG. 2 shows the front view of the preferred embodiment attached to the front of the engine viewed from FIG. 1 with the elimination of the cooling fan 52 for viewing. This system operates much like that of a electrical distributor in the same every day engine to operate the spark plug. The only exception is a fluid operated system, and rather than spark plugs, the valves are being opened and closed automatically with any choice of value duration, overlap and lift one would like to choose, you may choose your low r.p.m. setting and also your top r.p.m. setting, then automatically it changes with the r.p.m.s giving best performance always.

Figure 5:
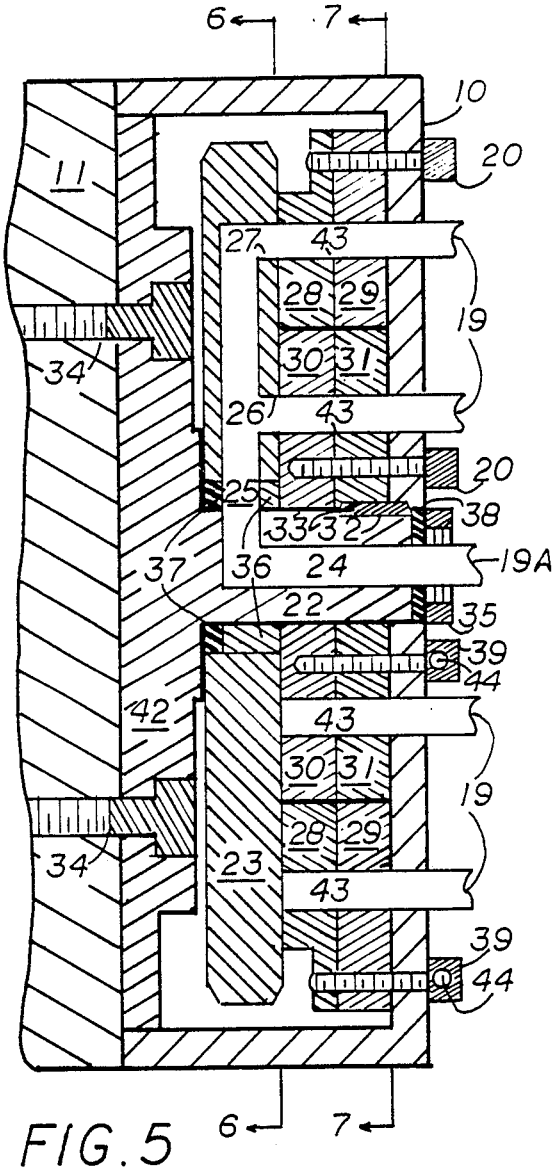
FIG. 5 is a sectional view of the gear driven rotor taken along 6—6 of FIG. 5.
Figure 6:
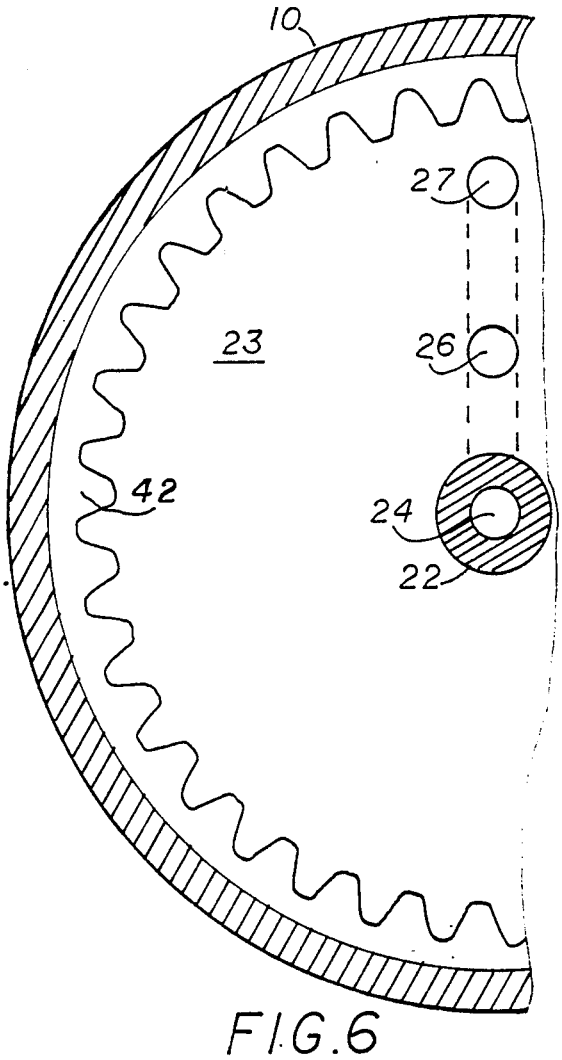
Figure 7:
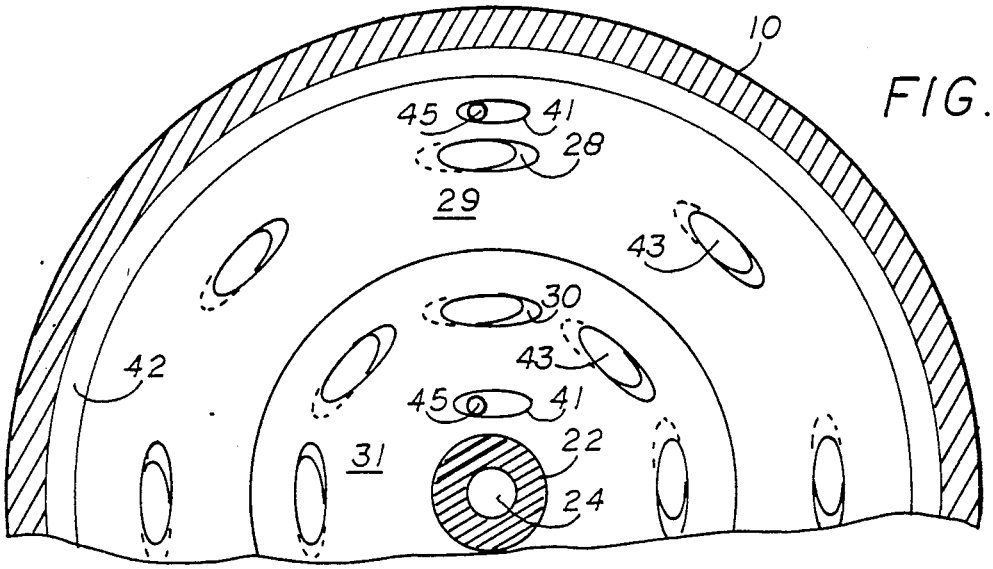
FIG. 7 is a sectional view of the adjustable aperture taken along 7—7 of FIG. 5.

Referring in greater detail to FIG. 2 the system 10 is operated by a chain (not shown) driven by the crankshaft 46, the same way any conventional timing system is operated on a ratio 2 to 1 in turn the inner gear rotor 23 of FIG. 6 spins locating with the adjusted aperture disks of FIG. 7, 28 primary intake disk and 29 secondary intake disk allowing a wide or narrow flow of fluid depending upon engine characteristics, also exhaust being independent of the intake, 30 primary and 31 secondary exhaust disk, two disk show how aperture size maybe altered from large to small. The independent system allows one to time an engine according to any chosen setting without hindering opposing values. Sat screw hole 45 along with the secondary disk 29 and 31 having an elongated hole allows movement for adjusting aperture size either manually or automatically, refer to FIG. 5 set screw 20 at upper portion of illustration, while the lower portion shows an automatic attaching arm pin 39 each for the intake and another for exhaust referring back to FIG. 4 shows two actuating piston bodies 47 intake 48 exhaust, actuating pistons are governed by oil pressure to govern a piston 49 of FIG. 4 a bleed screw 17 allows oil to bleed at low r.p.m.s consequently holding a small aperture adjustment, as engine r.p.m.s climb oil pressure increases and pushes attaching arm 39 opening a larger aperture for a large flow widening the valve action for top end performance. The actuating piston 49 system is used both for the aperture actuating and also to operate the engines intake and exhaust valves, with a few minor exceptions.

Figure 3:
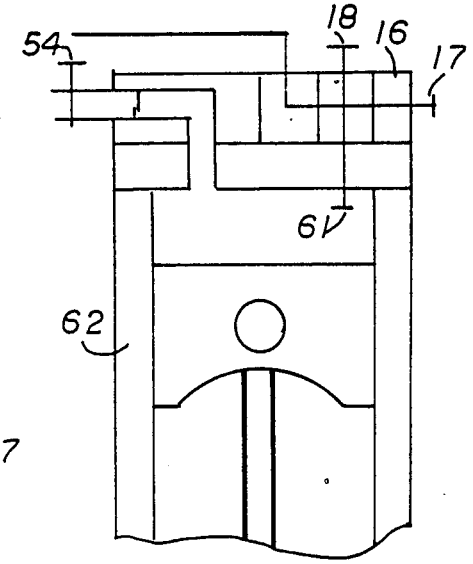
FIG. 3 is a parcial schematic in block diagram form showing of a alternative system according to the present invention.
Figure 8:
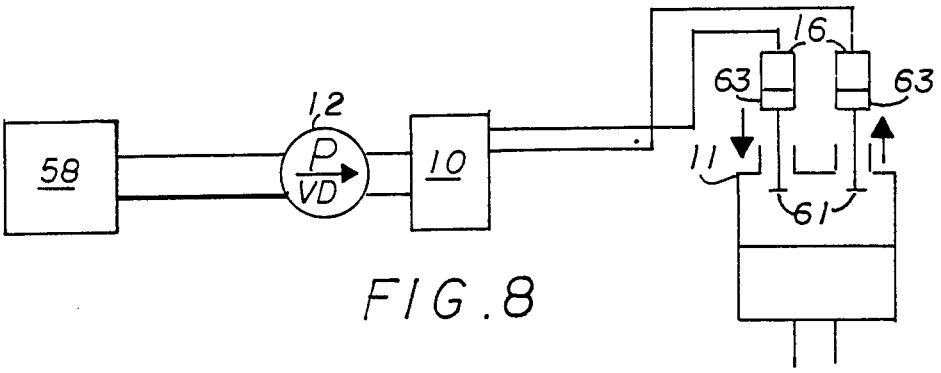
FIG. 8 is a schematic diagram of the preferred novel distributing hydraulic rotor cam system.
Figure 9:
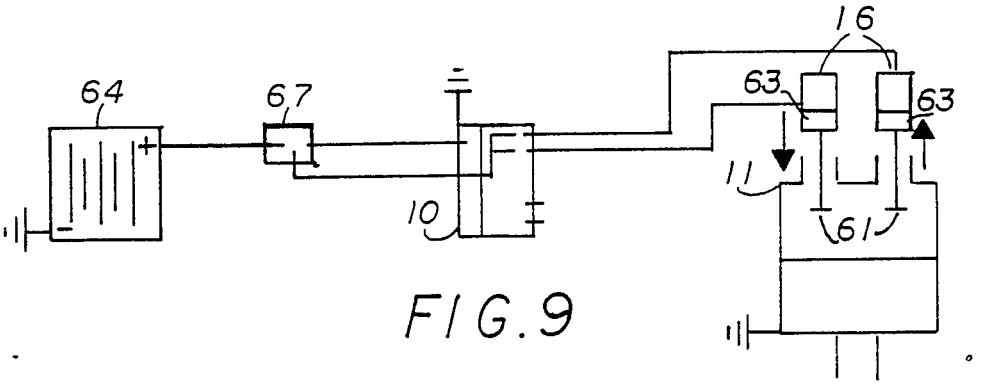
FIG. 9 is a schematic diagram of a alternative electrical system.
Figure 10:
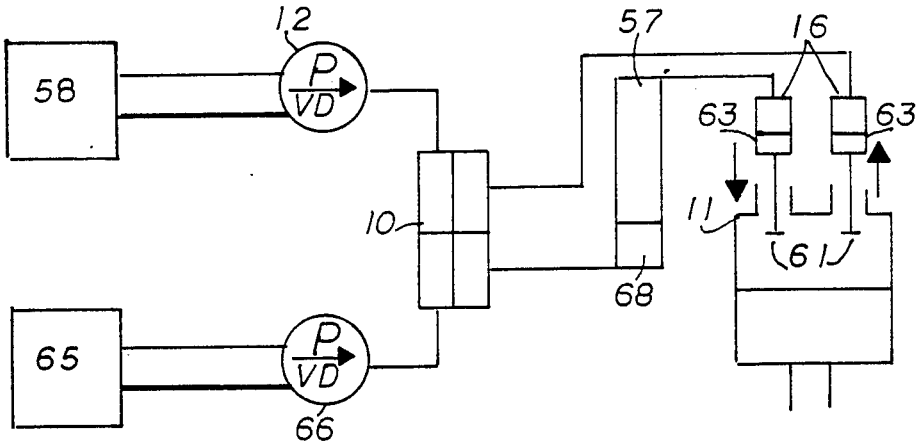
FIG. 10 is a schematic diagram of another alternative fuel and fluid combination, corresponding with FIG. 3 of the present invention.

Referring in greater detail to FIG. 5 embodiment 10 cut away portion of engine 11 shows mounted a fixed shaft on a base plate 42, bolted by bolts 34, a rotor feed gear 23 and located in the back thereof a seal 37 a rotor gear bearing 36 machined in a no leak system and a coaxial moveable aperture. Aperture plates 28 intake, 30 exhaust independent of each other while 29 and 31 secondary aperture are fixed nonmoveable, located on a keyway 33 located in key slot 32 surrounded by embodiment cover 10 and fixed with a seal 38 and lock nut 35. From a high pressure supply pump 12 oil is fed to embodiment 10 through high pressure line 19A feeds oil to collecting oil feed channel 24 through peripheral channel 25 and through rotor feed exhaust operating port 26, oil also feeds intake rotor port 27 travels through adjusted aperture opening 43 allowing proper valve duration and overlap adjustments. Oil then flows out high pressure line 19 to the head piece actuating piston body 16 whereby the oil actuates piston 49 opening the engines intake and exhaust valves 61. The set screw 17 is a bleed screw allowing oil to delay time of which the valve is opened for increased low end engine performance, as engine r.p.m.s increase oil leakage rate slows up due to time involved to bleed. The piston is moving so rapidly that there is no time to bleed opening the valve much sooner so that valve duration is widened for a large flow of fuel improving higher r.p.m. performance. Numeral 18 is a valve lift adjustment being attached to a piston 50, when moved lower, the volume of oil is pushing piston 49 lower increasing valve lift. This also can be done automatically by a oil feed line and a pressure relief valve to actuate said piston 50 showing a adjusting means 18 automatic oil feed line 19. FIG. 8, 9 and 10 show three schematics of their distinct different ways of operation. FIG. 8 is a schematic showing the preferred detailed embodiment 10 being fed by a high pressure pump 12, pumping oil from oil pan tank 58 through the novel unit 10 and through the secondary portion of the novel unit actuating the intake and exhaust valves of the engine 11. FIG. 9 shows the system being operated electronically, a 12 volt battery 64 feeding current to a coil 67, (coil can be eliminated depending on voltage required) power then is fed to distributor 10 feeding current to intake and exhaust receiver then carries to solenoid actuated piston 16. Solenoid may operate the electrical system in two ways, it may directly open the engine valves or open oil gallery valves, allowing oil to open and close the engines valves. FIG. 10 shows a combination of the above oil system FIG. 8 but operating only exhaust valves while intake valves are eliminated cutting down even further on friction, of course resulting in more horsepower. This is done by the novel distributing rotorcam. The system of which was explained in specification previously shows how oil is turned on and off whereby the valves open and close. Also, the gases can be regulated by the use of the distributor cam only by the proper aperture size, this will allow proper fuel flow. The distributing rotorcam can independently separate the fuel from the oil just in the same manner the intake and exhaust ports are separated, the exhaust side has already been explained above in FIG. 8. The intake side is fed by fuel tank 65 fuel pump 66 distributing cam 10 through fuel feed system 68 and through air blower 57 and directly to combustion chamber of engine 11, refer to FIG. 2, a one-way valve is placed between blower and combustion area to eliminate back pressure. Refer to FIG. 3 62 being a block diagram 53 shows intake coupling means therein adjusting means 54 a check valve 55 eliminating back pressure. The right side shows the other half operating by oil opening valve 61 having a spring 63, head piece is part two of the preferred novel invention. Other numerals not explained are timing mark 60 which lines up with crankshaft mark (not shown) 59 support means for actuating piston embodiment 16. 46 crankshaft shown on FIG. 2 to operate said embodiment 10 the oil feed shaft 22 is all one part in conjunction with 42 shaft base mounting plate. The primary feed line 21 keeps the unit primed with normal oil pressure so valves will open when cold, shown on FIG. 2. 40 fixed oil feed shaft bolt hole immaterial numerical error (not shown). 41 elongated hole for aperture control shown FIG. 7. 44 is the attaching pin for automatic perture control. 51 is the valve delay bleed duct.

The device as shown can of course be modified within the scope of the appended Claims and specifically here are some modifications which might be desirable.

A main novel modification is this unit can directly attch to a crankshaft eliminating the gear drive and chain, the ratio difference would be compensated within the device to correspond a 2 to 1 ratio. Other modifications for example the aperture opening may also be operated by other than movable disks, it may have internal channel feed means whereby check valves regulate the duration or fluid being passed through the distributor, somewhat like a valve body on the automatic transmissions of today which regulates shifting times. The unit may also be a one complete unit including the high pressure oil pump to be incorporated within the distributor to be driven off the rotor gear by the crankshaft, a direct drive pump. The driven rotor gear maybe attached to the original camshaft for stronger stability, the original camshaft being nonfunctional would spin, allowing the normal oil journals to remain sealed. The gear would then have a hollow feed shaft attached to the gear as a one piece unit rotor gear, of which aligns with sealed aperture, the aperture and face plate would remain fixed, stationary with high pressure oil feed line on a communtator coupler. The lifter holes located within the engine would be plugged in every application preventing oil leakage. The actuating pistons located on the distributor shown on FIG. 2 maybe internal or external as shown.

Other changes is whereby the head piece, actuating valve system is a solid block unit or individualy attached units. Adjusting means whereby on the one piece unit maybe equipped with one fine tuning bleed port for all on individual adjustments.

Fuel and oil combination units may also be coaxial shaft separating feed lines etc. electrical device may also be operated by a computing device allow electronic opening and closing means.

The unique features is where you may time your engine for any size cam, mild street or wild dragstrip competition, by merely the turn of a few screws, and automatically changes itself smaller or larger by r.p.m. changes.

Oil, gas and electricity is represented by a medium mass.

Although I have discribed my invention with a certain degree of particularity, it is understood that the present disclosure has been made only by way of example and that numerous changes in the details of construction and the combination and arrangement of parts may be resorted to: without departing from the spirit and the scope of the invention as hereinafter claimed.

What is claimed is:

1. In an internal combustion engine having a plurality of combustion chambers each of which has an intake valve and an exhaust valve, the invention comprising:

a fluid reservoir;

a high pressure fluid pump connected to said fluid reservoir;

a high pressure fluid distributor assembly connected to said high pressure fluid pump, said distributor assembly having a rotor fixedly mounted on a shaft so that they rotate as one, said rotor being in the form of a disc having a front face and a rear face, said rotor having a radially extending fluid passage within its interior, said fluid passage having an inner end and an outer end, means connecting said inner end to said high pressure fluid pump;

said rotor having at least a first outlet port on its front face that is in communication with the fluid passage within said rotor;

each of the valves of the engine having an actuation unit connected to the top of said valve for opening said valve at a predetermined time;

manifold means periodically connecting said fluid passage to each of said individual actuation units in a predetermined sequence, said manifold means having at least a primary annular shaped disc that is positioned flush against the front face of said rotor, said primary disc having a predetermined number of aperatures spaced circumferentially about a radius on said primary disc equal to that of the radius of said first outlet port, said individual apertures each being connected to its own separate valve actuation unit; and means for rotating said rotor.

2. The invention recited in claim 1 further comprising a secondary disk that seats within said primary disk, said secondary disk being positioned flush against the front face of said rotor, said rotor having a second outlet port on its face that is in communication with the fluid passage within said rotor, said secondary disk having a predetermined number of apertures spaced circumferentially about a radius on said secondary disk equal to that of the radius of said secondary outlet port, said individual apertures each being connected to its own separate valve actuation unit.

3. The invention recited in claim 2 wherein the apertures in said primary and secondary disks have an oval shape.

4. The invention recited in claim 2 further comprising means for varying the flow of high pressure fluid through said apertures in said primary and secondary disks.

5. In an internal combustion engine having a plurality of combustion chambers each of which has an intake valve and an exhaust valve, the invention comprising:

a fluid reservoir;

a high pressure fluid pump connected to said fluid reservoir;

a high pressure fluid distributor assembly connected to said high pressure fluid pump;

said distributor assembly having a rotor fixedly mounted on a shaft so that they rotate as one, said rotor being in the form of a solid disc having a front face and a rear face, said rotor having a radially extending fluid passage within its interior, said fluid passage having an inner end and an outer end, means connecting the inner end of the fluid passage within said rotor to said high pressure fluid pump comprising an axial bore hole in said shaft that aligns with an inlet port on the front face of said rotor, said inlet port being connected to inner end of said fluid passage;

said rotor having a first outlet port on its front face that is in communication with the fluid passage within said rotor, said rotor having a second outlet port on its front face that is in communication with the fluid passage within said rotor, said outlet ports being radially spaced from each other;

each of the valves of the engine having an actuation unit connected to the top of said valves for opening said valve at a predetermined time;

manifold means periodically connecting said fluid passage to each of said individual actuation units in a predetermined sequence; and means for rotating said rotor.

6. The invention recited in claim 5 wherein said means for rotating said rotor comprises gear teeth on the outer radial surface of said disk.

7. The invention recited in claim 5 wherein each of said actuation units have a piston that is connected to the top end of a valve stem.

8. The invention recited in claim 5 wherein each of said actuation units have bleed down means for allowing the valves to close.

9. In an internal combustion engine having a plurality of combustion chambers each of which has an intake valve and an exhaust valve, the invention comprising:

each of said intake valves and exhaust valves having a return spring for closing said valves;

each of said intake valves and exhaust valves having an actuation unit connected to the top of said valve for opening said valves at a predetermined time;

a source of power;

a distributor assembly connected to said power source, said distributor assembly having properly timed rotary means for sequentially transmitting power from said power source to each of said actuation units in a predetermined order for opening their valves; and delay means that operate to counter the force of said return springs for closing said intake and exhaust valves and for delaying the opening of the valves and shortening the closing points of said intake valves and exhaust valves to automatically allow the opening cycle of the valve to open later and close quicker at low engine rpm and to automatically open sooner and stay open longer at higher engine rpm.

10. In an internal combustion engine having a plurality of combustion chambers each of which has an intake valve and an exhaust valve, the invention comprising:

each of said intake valves and exhaust valves having a return spring for closing said valves;

each of said intake valves and exhaust valves having an actuation unit connected to the top of said valve for opening said valves at a predetermined time;

a source of power;

a distributor assembly connected to said power source, said distributor assembly having properly timed rotary means for sequentially transmitting power from said power source to each of said actuation units in a predetermined order for opening their valves; and said actuation units having means that operate to counter the force of said return valve springs for closing said intake and exhaust valves and for delaying the opening of the valves and shortening the closing points of said intake valves and exhaust valves to automatically allow the opening cycle of the valve to open later and close quicker at low engine rpm and to automatically open sooner and stay open longer at higher engine rpm.

11. The invention recited in claim 10 wherein each of said actuation units comprises a source of power to operate the opening of the intake valves and exhaust valves and a second source of power in said actuation unit connected to means for varing valve lift automatically according to engine rpm.

* * * * *